US009061402B2

(12) United States Patent
Harvey

(10) Patent No.: US 9,061,402 B2
(45) Date of Patent: Jun. 23, 2015

(54) WRENCH

(71) Applicant: Milwaukee Electric Tool Corporation, Brookfield, WI (US)

(72) Inventor: Kyle Harvey, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 221 days.

(21) Appl. No.: 13/796,946

(22) Filed: Mar. 12, 2013

(65) Prior Publication Data

US 2013/0327186 A1 Dec. 12, 2013

Related U.S. Application Data

(60) Provisional application No. 61/656,273, filed on Jun. 6, 2012.

(51) Int. Cl.
*B25B 13/14* (2006.01)

(52) U.S. Cl.
CPC ..... *B25B 13/14* (2013.01)

(58) Field of Classification Search
CPC ..... B25B 13/14
USPC ..... 81/126, 128, 143, 145, 157, 165, 173, 81/175, 176
See application file for complete search history.

(56) References Cited

U.S. PATENT DOCUMENTS

| | | | | |
|---|---|---|---|---|
| 1,133,236 | A | 3/1915 | Peterson | |
| 1,171,939 | A * | 2/1916 | Ginsburg | 81/126 |
| 1,506,362 | A * | 8/1924 | Carman | 81/361 |
| 2,562,060 | A * | 7/1951 | Pehrsson | 81/126 |
| 2,970,502 | A * | 2/1961 | Nordgren | 81/126 |
| 3,161,092 | A * | 12/1964 | Davis | 81/128 |
| 3,349,654 | A * | 10/1967 | Nordgren | 81/126 |
| 3,407,689 | A * | 10/1968 | Slayton | 81/134 |
| 4,028,970 | A | 6/1977 | Pelczar | |
| 4,449,431 | A | 5/1984 | Brunosson | |
| D292,666 | S | 11/1987 | Jansson et al. | |
| 5,297,459 | A * | 3/1994 | Stojanowski | 81/165 |
| 5,535,650 | A | 7/1996 | McNatt | |
| 5,890,404 | A * | 4/1999 | Stojanowski | 81/165 |
| 5,941,142 | A * | 8/1999 | Janson | 81/165 |
| 6,145,415 | A * | 11/2000 | Liu | 81/143 |
| D445,656 | S | 7/2001 | Ranieri et al. | |

(Continued)

FOREIGN PATENT DOCUMENTS

WO 2010002239 1/2010

OTHER PUBLICATIONS

PCT/US2013/044578 International Search Report ant Written Opinion dated Aug. 26, 2013 (14 pages).

*Primary Examiner* — David B Thomas
(74) *Attorney, Agent, or Firm* — Michael Best & Friedrich LLP

(57) ABSTRACT

A wrench is configured to rotate a fastener. The wrench includes a handle and a head pivotally coupled to the handle. The head includes a first jaw configured to engage the fastener and a second jaw configured to engage the fastener. The second jaw is movable with respect to the first jaw to adjust a distance between the first jaw and the second jaw. The wrench also includes an actuator operable to move the second jaw with respect to the first jaw to adjust the distance. The handle is pivotally coupled to the head such that rotation of the handle with respect to the head moves the second jaw toward the first jaw.

15 Claims, 8 Drawing Sheets

(56) References Cited

U.S. PATENT DOCUMENTS

| | | | | |
|---|---|---|---|---|
| 6,418,819 | B1 * | 7/2002 | Kuo | 81/165 |
| 6,530,298 | B1 * | 3/2003 | Steffe | 81/179 |
| 6,568,300 | B1 | 5/2003 | Steffe | |
| 6,595,089 | B1 | 7/2003 | Stojanowski | |
| 6,848,342 | B2 | 2/2005 | Bergfeld, III | |
| 7,137,321 | B1 * | 11/2006 | Huang | 81/126 |
| 7,275,464 | B2 | 10/2007 | Chervenak et al. | |
| 7,806,025 | B2 | 10/2010 | Xinhong | |
| 2003/0084757 | A1 * | 5/2003 | Chen | 81/165 |
| 2005/0109168 | A1 * | 5/2005 | Clauson | 81/165 |
| 2007/0175300 | A1 | 8/2007 | Burry et al. | |
| 2009/0193939 | A1 | 8/2009 | Chiu et al. | |
| 2009/0193941 | A1 | 8/2009 | Chiu et al. | |
| 2009/0320650 | A1 | 12/2009 | Alford | |
| 2011/0120277 | A1 | 5/2011 | Wu | |
| 2012/0055292 | A1 * | 3/2012 | Cheng | 81/165 |
| 2012/0312129 | A1 * | 12/2012 | Huang | 81/165 |
| 2013/0247725 | A1 * | 9/2013 | Huang | 81/126 |

* cited by examiner

WRENCH

CROSS-REFERENCE TO RELATED APPLICATIONS

This application claims priority to U.S. Provisional Patent Application No. 61/656,273, filed Jun. 6, 2012, the entire contents of which are hereby incorporated by reference herein.

BACKGROUND

The present invention relates to wrenches, and more particularly to adjustable wrenches.

Some types of conventional, adjustable wrenches include a fixed jaw and a movable jaw coupled to the fixed jaw by an adjustment mechanism. The positioning mechanism of such an adjustable wrench can be manipulated to adjust the spacing between the fixed jaw and the movable jaw, allowing the wrench to accommodate a variety of differently sized fasteners. However, unless the positioning mechanism is precisely set, the fixed jaw and the movable jaw can be spaced too far apart and slip on the fastener, causing undesirable damage (e.g., rounding) to the fastener. Alternatively, the fixed jaw and the movable jaw can be spaced too close together, binding the wrench on the fastener and/or requiring readjustment of the positioning mechanism.

SUMMARY

In one embodiment, the invention provides a wrench configured to rotate a fastener. The wrench includes a handle and a head pivotally coupled to the handle. The head includes a first jaw configured to engage the fastener and a second jaw configured to engage the fastener. The second jaw is movable with respect to the first jaw to adjust a distance between the first jaw and the second jaw. The wrench also includes an actuator operable to move the second jaw with respect to the first jaw to adjust the distance. The handle is pivotally coupled to the head such that rotation of the handle with respect to the head moves the second jaw toward the first jaw.

In another embodiment, the invention provides a wrench configured to rotate a hex head nut. The wrench includes a handle and a head pivotally coupled to the handle. The head includes a first jaw including a first contact surface configured to engage the hex head nut. The head also includes a second jaw including a second contact surface configured to engage the hex head nut. The second contact surface is parallel to the first contact surface, and the second jaw is movable with respect to the first jaw to adjust a distance between the first and second contact surfaces. The wrench also includes a rack gear fixed to the second jaw for movement with the second jaw relative to the first jaw. The wrench also includes a worm gear rotatable with respect to the first jaw to move the rack gear and the second jaw with respect to the first jaw to adjust the distance between the first contact surface and the second contact surface. The wrench also includes a lever pivotally coupled to the head. The lever is pivotable with respect to the head to move the second jaw toward the first jaw in response to rotation of the handle with respect to the head to increase a clamping force of the first jaw and the second jaw on the hex head nut.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
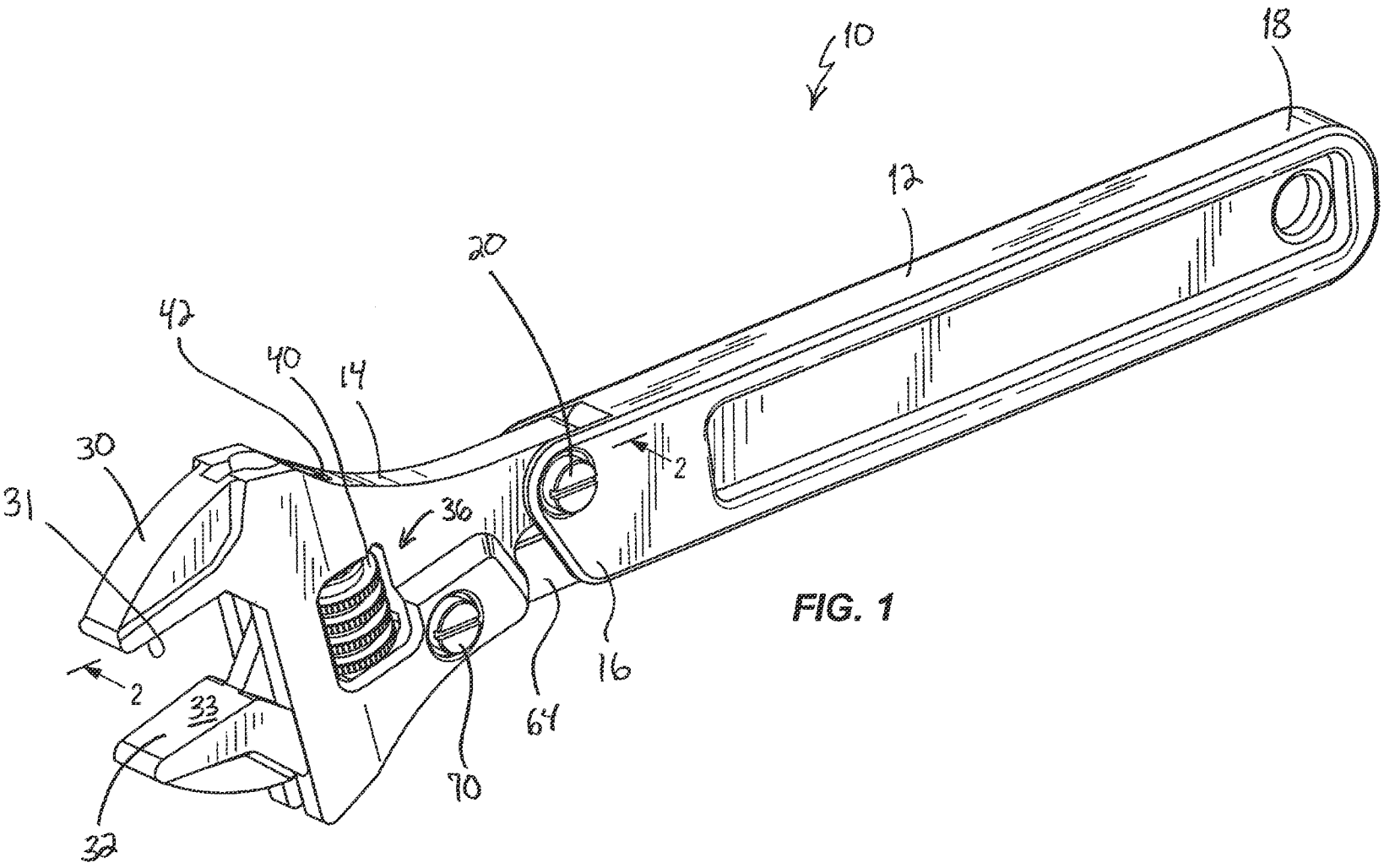
FIG. 1 is a perspective view of a wrench according to an embodiment of the invention.

FIG. 1 illustrates a wrench 10. The wrench 10 includes a handle 12 and a head 14. The handle 12 is elongated and has a front end portion 16 and a rear end portion 18. The handle includes an aperture 19 extending through the handle 12 at the rear end portion 18. The aperture 19 provides a location for hanging the wrench 10 (e.g., for storage purposes). In some embodiments, the aperture 19 can be shaped as a drive, such as a multi-point drive, a hex-drive, or a square drive. The head 14 is pivotally coupled to the handle 12 at the front end portion 16 of the handle 12. The head 14 is pivotally coupled to the handle 12 via a pin 20 such that the handle 12 rotates with respect to the head 14 about the pin 20 in the direction of arrows 22 and 24 in FIGS. 2 and 3.

The head 14 includes a first or fixed jaw 30 having a generally planar contact surface 31 and a second or movable jaw 32 having a generally planar contact surface 33. In the illustrated construction, the contact surface 31 extends generally parallel to the contact surface 33. The head 14 further includes an actuator 36, which is a worm drive in the illustrated embodiment. The worm drive 36 includes a rack gear 38 and a worm gear 40. The rack gear 38 is fixed to the movable jaw 32 for movement with the movable jaw 32 relative to the fixed jaw 30. The rack gear 38 is received in a generally cylindrical aperture 42 of the head 14. The aperture 42 guides the generally cylindrical rack gear 38 to guide movement of the jaw 32 so that the jaw 32 moves parallel to the arrows 44 and 46 in FIGS. 2 and 3.

The worm gear 40 is rotatably coupled to the head 14 via a pin 50 and the worm gear 40 rotates about the pin 50 and meshes with the rack gear 38 to move the jaw 32 in the direction of arrows 44 and 46 relative to the fixed jaw 30. The pin 50 includes a threaded portion 52 and a generally smooth portion 54. The threaded portion 52 couples the pin 50 to the head 14, and via a set screw 56, the pin 50 is held from rotation with respect to the head 14. A biasing member 58, which is a coil spring in the illustrated embodiment, surrounds the pin 50. The spring 58 abuts the threaded portion 52 of the pin 50 and the worm gear 40 to bias the worm gear 40 in the direction of arrow 60 relative to the head 14 and the pin 50. Because the worm gear 40 is engaged with the rack gear 38, the spring 58 also biases the movable jaw 32 in the direction of the arrow 46 and away from the fixed jaw 30.

The wrench 10 further includes a lever 64. The lever 64 includes a first end portion 66 and a second end portion 68, and the lever 64 is pivotally coupled to the head 14 by a pin 70 such that the lever 64 rotates with respect to the head 14 about the pin 70 in the direction of arrows 72 and 74 in FIGS. 2 and 3. The first end portion 66 includes a sleeve 75 that slides along the pin 50 of the worm gear 40 in the direction of arrows 60 and 76 in FIGS. 2 and 3 to move the worm gear 40 in the direction of arrow 76 along the pin 50. The second end portion 68 of the lever 64 includes a follower 78. The follower 78 rides along a generally flat surface 80 of the handle 12 such that rotation of the handle 12 about the pivot pin 20 relative to the head 14 causes the follower 78 to ride along the surface 80, which rotates the lever 64 about the pin 70.

In operation, the user can use the wrench 10 to turn a fastener 82, which is a hex head nut in the illustrated application. In other applications, the wrench 10 can be used rotate bolts, other shapes of fasteners (e.g., square head nuts and bolts), and the like. To rotate the fastener 82, the user rotates the worm gear 40 about the pin 50. As the user rotates the worm gear 40, the meshing between the gear 40 and the rack gear 38 causes the movable jaw 32 to move in the direction of either arrow 60 or 76 depending on which direction the worm gear 40 is rotated. The user rotates the worm gear 40 to adjust a spacing 84 (FIG. 2) between the jaws 30 and 32 (i.e., a perpendicular distance between contact surfaces 31 and 33 of the jaws 30 and 32). The user adjusts the spacing 84 (FIG. 2) so that the spacing 84 is slightly larger than a distance 86 between opposite flat sides of the fastener 82. With the spacing 84 slightly larger than the distance 86 (i.e., fastener size) the jaws 30 and 32 easily fit onto the fastener 82 because the jaws 30 and 32 do not bind on the fastener 82 and the fastener 82 easily fits between the jaws 30 and 32 because of a gap 88. Then, the user further rotates the worm gear 40 to reduce the spacing 84 between the jaws 30 and 32 until the contact surfaces 31 and 33 of the jaws 30 and 32 contact the fastener 82 (i.e., the spacing 84' (FIG. 3) between the jaws 30, 32 is approximately the same as the size 86 of the fastener 82).

Figure 2:
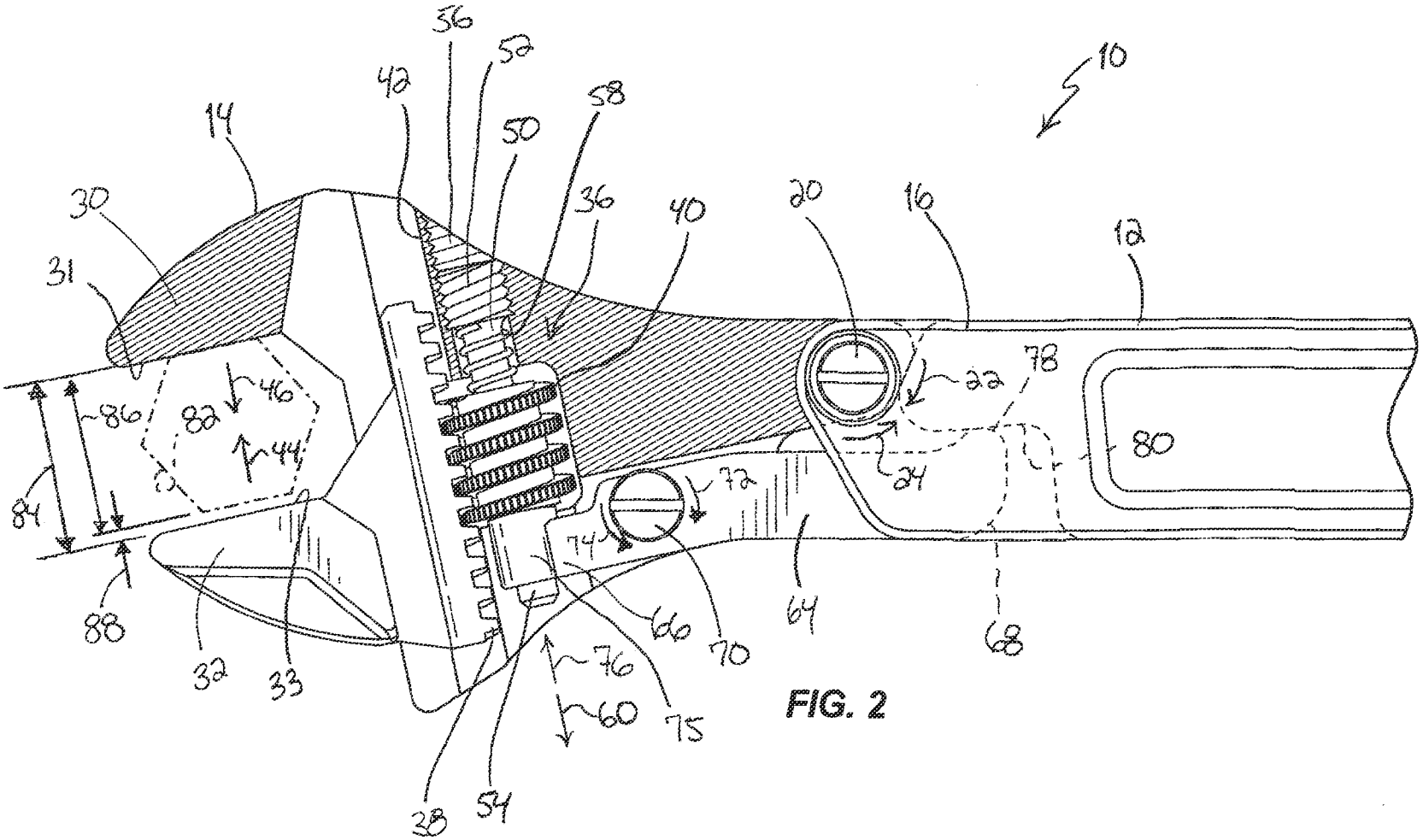
FIG. 2 is a partial cross-sectional view of the wrench of FIG. 1 taken along lines 2-2 of FIG. 1 showing the wrench in a first operating state.
Figure 3:
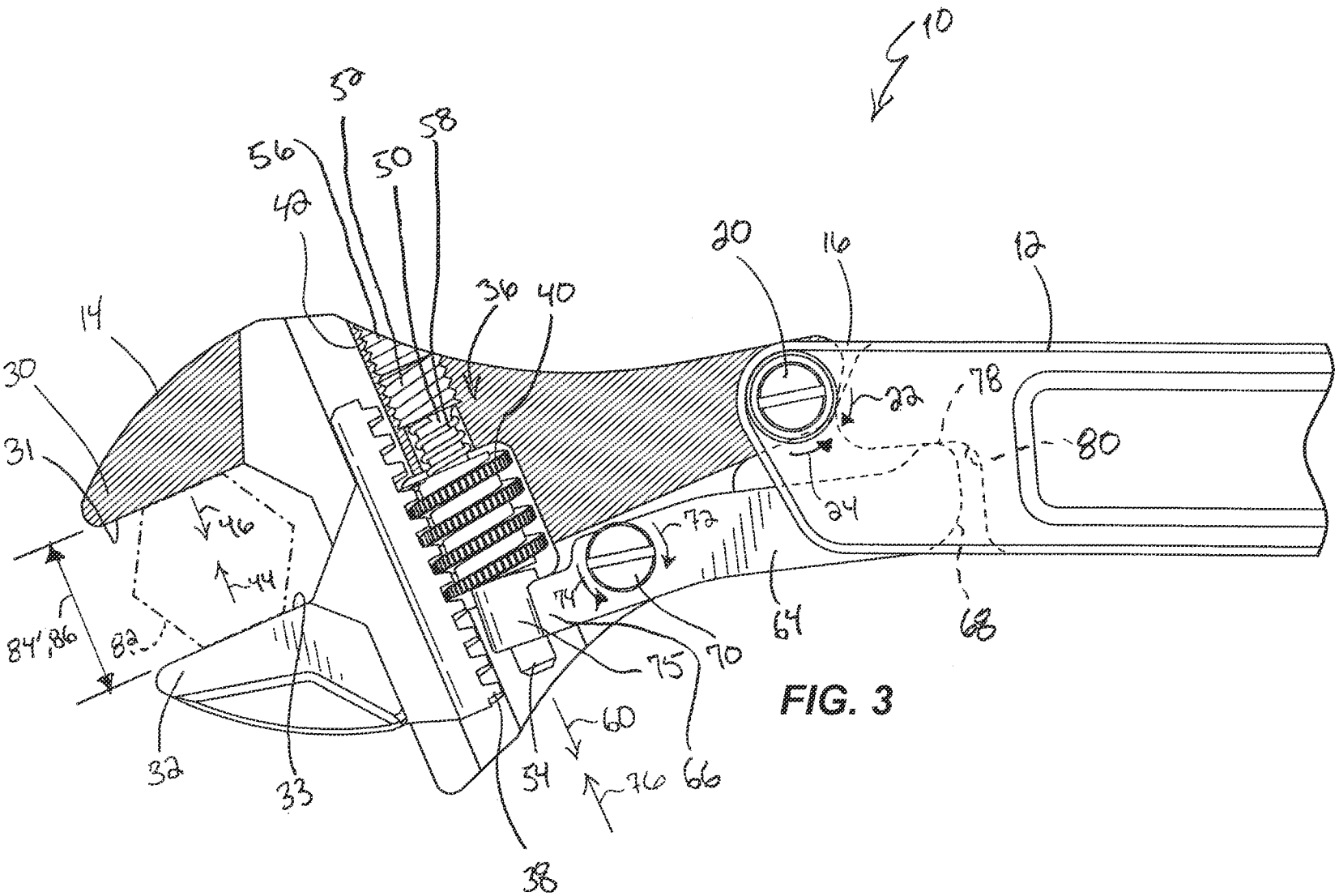
FIG. 3 illustrates the wrench of FIG. 2 in a second operating state.

With the jaws 30, 32 in the position illustrated in FIG. 3, the user rotates the handle 12 about the fastener 82 (clockwise as illustrated in FIGS. 2 and 3), which causes the handle 12 to rotate relative to the head 14 about the pivot pin 20 in the direction of arrow 22. As the handle 12 rotates about the pin 20, the follower 78 rides along surface 80, which causes the lever 64 to rotate in the direction of arrow 72 about the pin 70. As the lever 64 rotates in the direction of arrow 72, the sleeve 75 moves in the direction of arrow 76, which pushes the worm gear 40 to slide the worm gear 40 in the direction of arrow 76 against the bias of spring 58. The worm gear 40 is meshed with the rack gear 38 so movement of the worm gear 40 in the direction of arrow 76 along the pin 50 also causes the jaw 32 to move in the direction of arrow 44 relative to the jaw 30. The handle 12 rotates about the pin 20, and the lever 64 rotates about the pin 70 to move the movable jaw 32 very slightly the direction of arrow 44 to increase the clamping force of the jaws 30, 32 on the fastener 82 and so that both jaws 30, 32 fit snuggly on the fastener 82 as illustrated in FIG. 3. The additional clamping force of the jaws 30, 32 on the fastener 82 reduces the chance for rounding off the sharp corners of the fastener 82.

When the user is finished rotating the fastener 82, the spring 58 pushes on the worm gear 40 to automatically move the worm gear 40 a very small distance along the pin 50 in the direction of arrow 60 to reduce the clamping force of the jaws 30, 32 on the fastener 82. Movement of the worm gear 40 in the direction of arrow 60 is limited by the worm gear 40 contacting the head 14 as best shown in FIG. 1. This movement also causes the rack gear 38 and the movable jaw 32 to move slightly in the direction of arrow 46 to reduce the clamping force of the jaws 30, 32 on the fastener 82. With the clamping force decreased, the user can easily remove the jaws 30, 32 from the fastener 82 because the jaws 30, 32 do not bind on the fastener 82.

Figure 4:
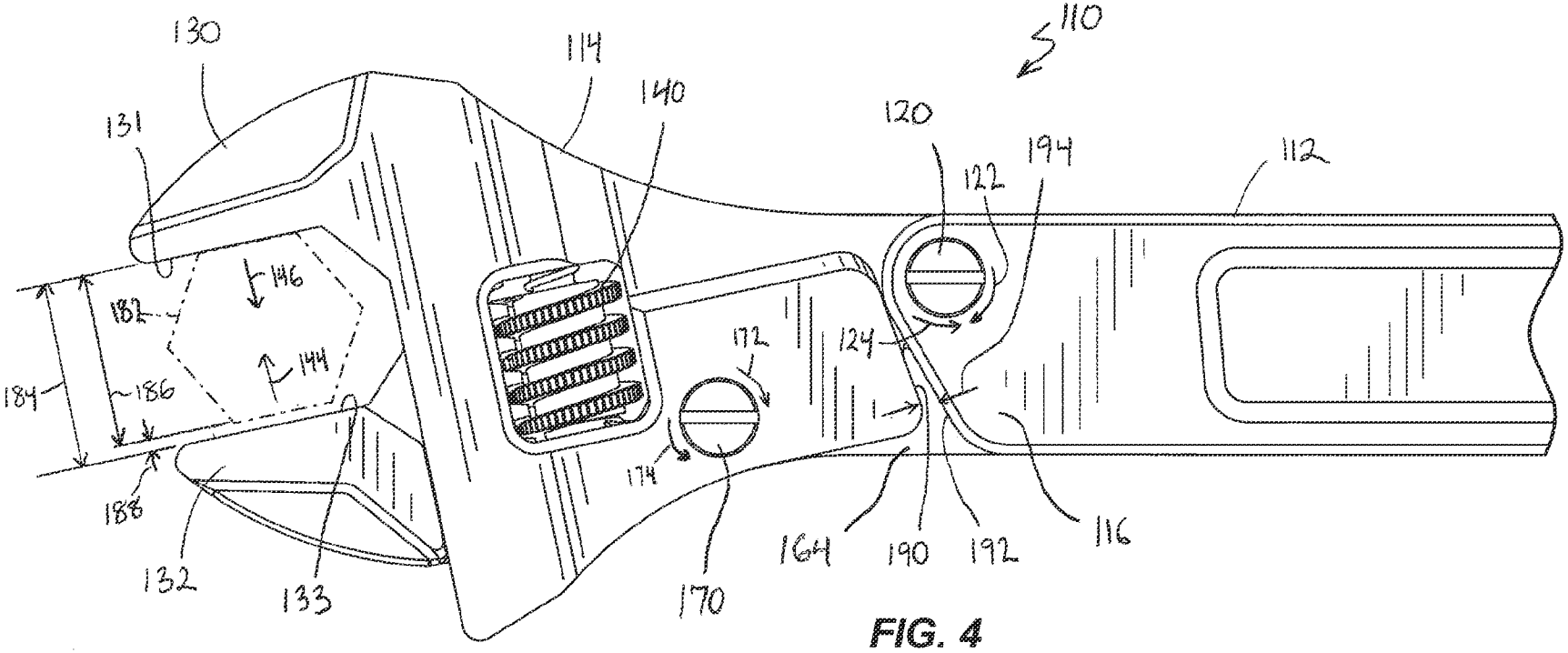
FIG. 4. is a front view of a portion of a wrench according to another embodiment of the invention.
Figure 5:
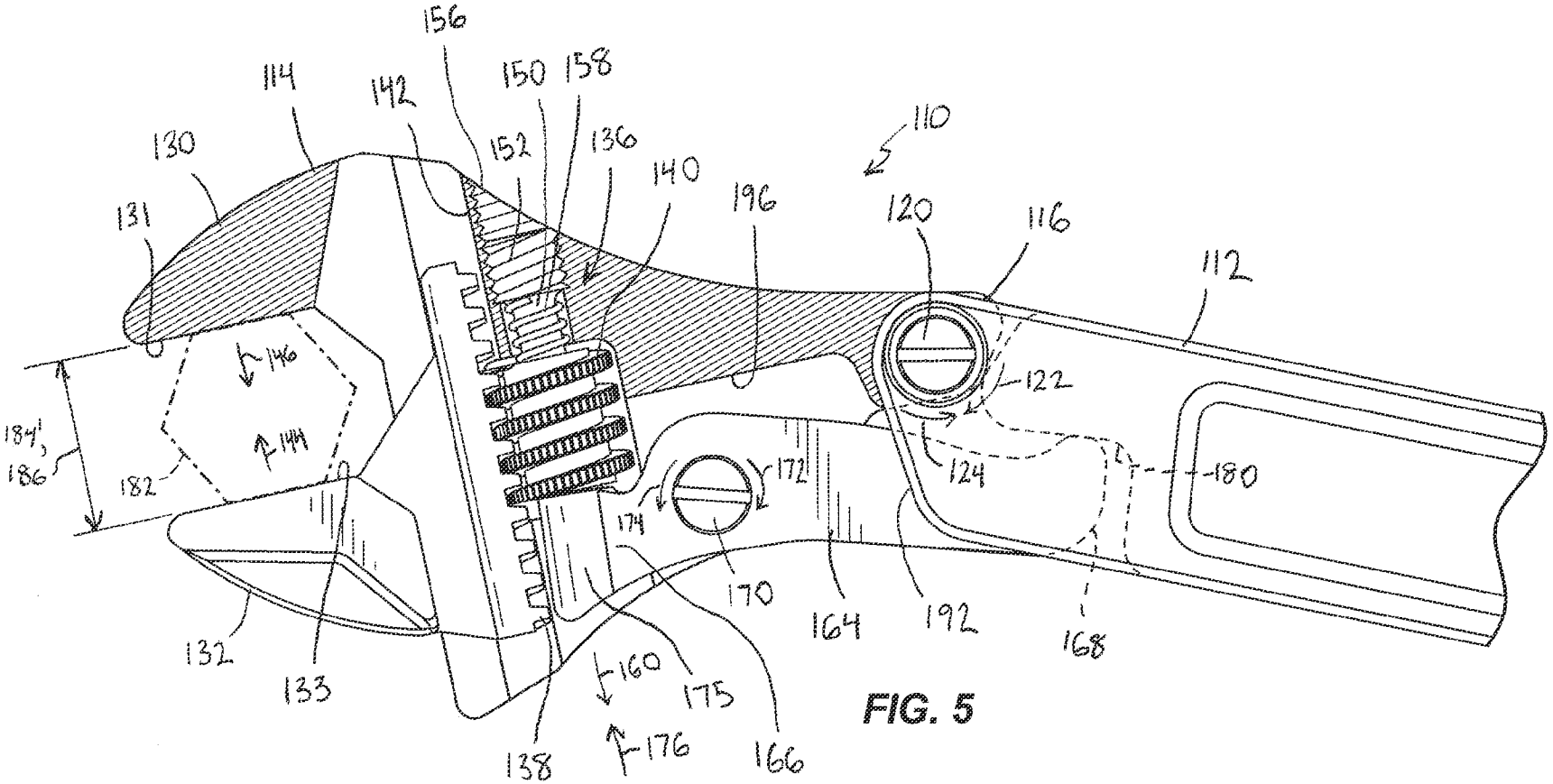
FIG. 5 illustrates a partial cross-sectional view of the wrench of FIG. 4 in a second operating state.

FIGS. 4 and 5 illustrate a wrench 110 according to another embodiment of the invention. The wrench 110 is similar to the wrench 10; therefore, like components have been given like reference numbers plus 100 and only differences between the wrenches 10 and 110 will be discussed in detail. With reference to FIG. 4, the fixed jaw 130 of the wrench 110 includes a proximal surface 190 and the handle 112 includes a distal surface 192. The proximal surface 190 of the fixed jaw 130 and the distal surface 192 of the handle 112 define a small gap 194 when the wrench 110 is in the position illustrated in FIG. 4.

Referring to FIG. 5, the lever 164 of the wrench 110 has a wider shape than the lever 64 of the wrench 10 described with reference to FIGS. 1-3. The illustrated configuration of the lever 164 can improve the strength, durability, and/or manufacturability of the lever 164. The fixed jaw 130 of the wrench 110 includes a recess 196 to accommodate the wider lever 164.

In operation, as the handle 112 is pivoted relative to the head 114 about the pivot pin 120 in the direction of arrow 122, (i.e., towards the position illustrated in FIG. 5), the gap 194 between the proximal surface 190 and the distal surface 192 closes, and the proximal surface 190 abuts the distal surface 192. This contact between the surfaces 190 and 192 limits the pivotal movement of the handle 112 with respect to the head 114 and reduces the stress applied to the lever 164.

Figure 6:
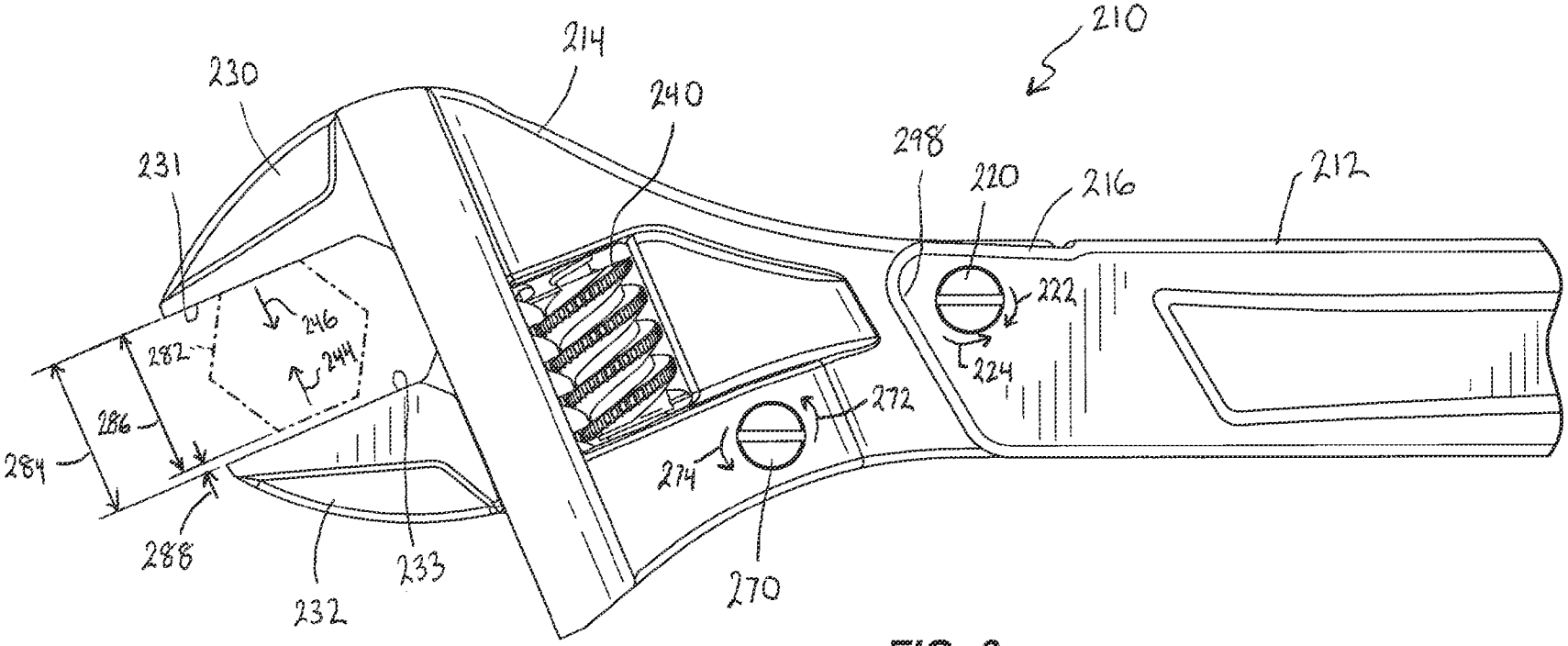
FIG. 6 is a front view of a portion of a wrench according to another embodiment of the invention.
Figure 7:
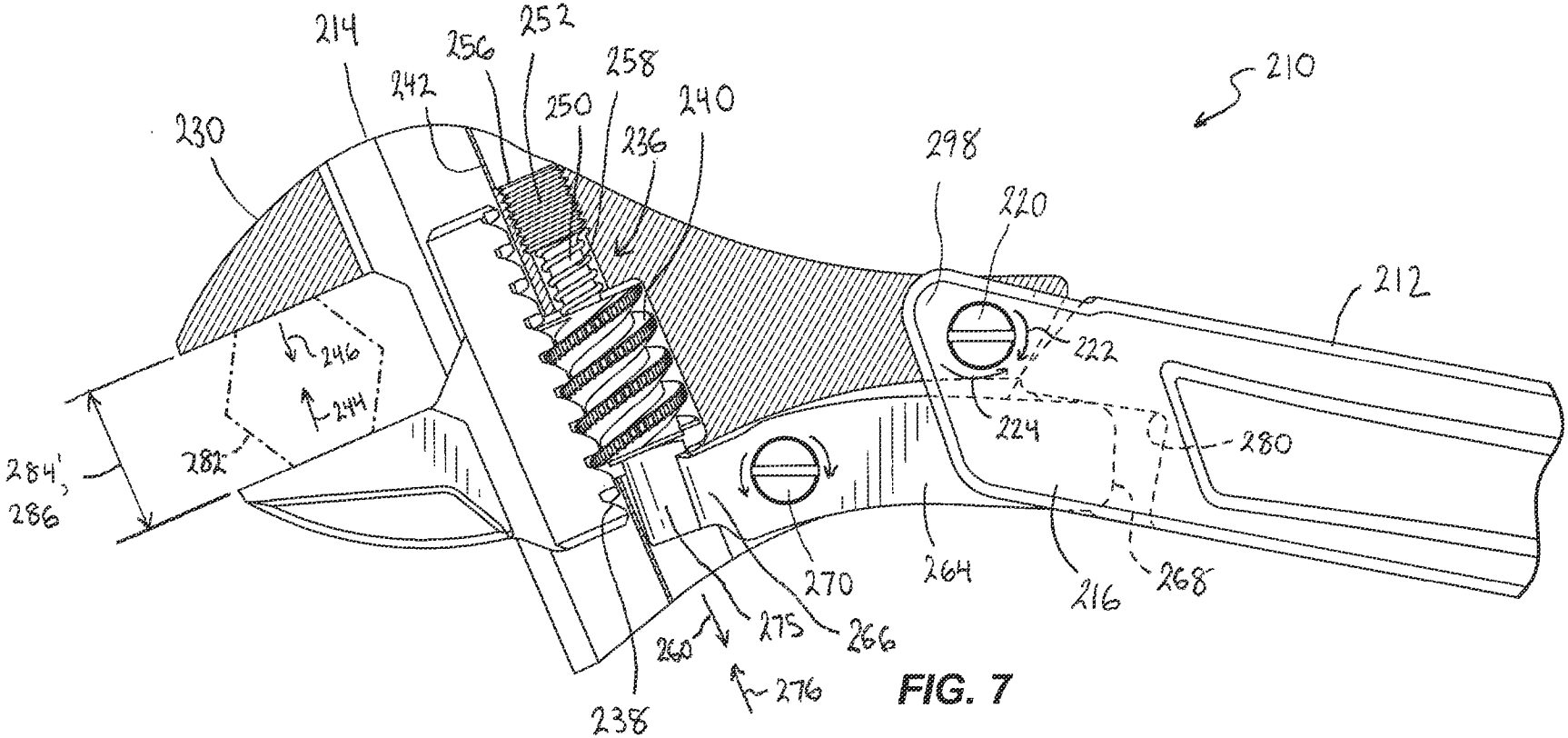
FIG. 7 illustrates a partial cross-sectional view of the wrench of FIG. 6 in a second operating state.
Figure 8:
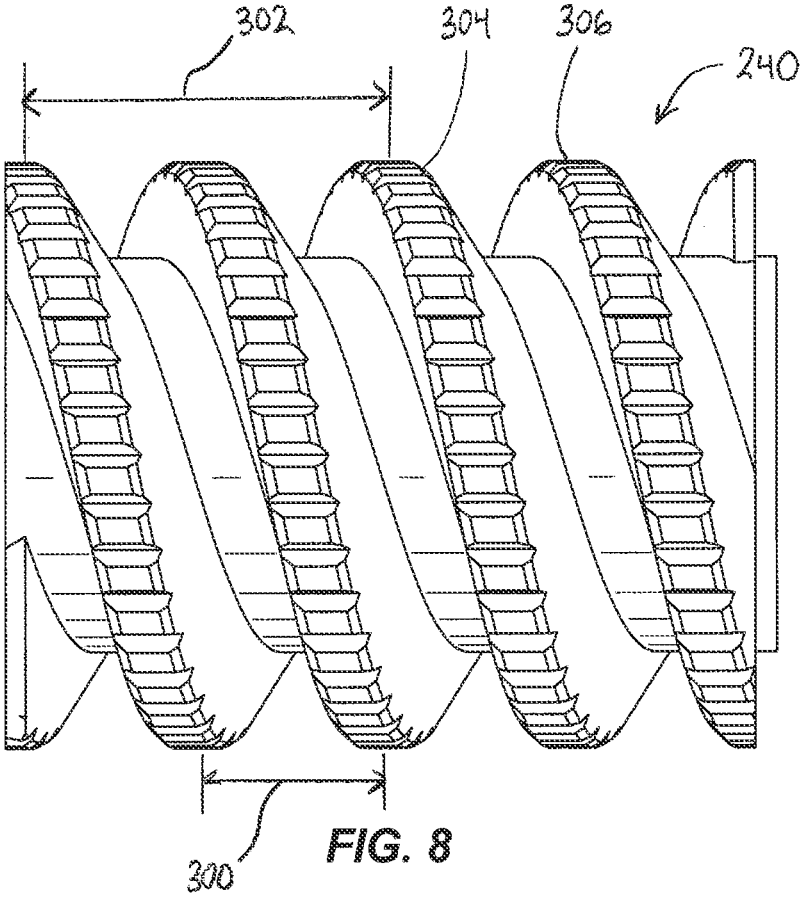
FIG. 8 is a front view of a worm gear of the wrench of FIG. 6.

FIGS. 6-8 illustrate a wrench 210 according to yet another embodiment of the invention. The wrench 210 is similar to the wrench 10; therefore, like components have been given like reference numbers plus 200 and only differences between the wrenches 10 and 210 will be discussed in detail. With reference to FIG. 6, the front end 216 of the handle 212 includes a sheath portion 298 extending along the head 214. In operation, the sheath portion 298 substantially covers the lever 264 and slides along the head 214 when the handle 212 rotates relative to the head 214 about the pivot pin 220 in the direction of arrow 222. As such, the sheath portion 298 provides a degree of protection to the lever 264 and covers the gap 194 that existed in the embodiment of FIGS. 4-5.

With reference to FIGS. 7 and 8, the worm gear 240 of the worm drive 236 is configured as a double-lead worm gear 240 (also referred to as a double-start or double-threaded worm gear). The worm gear 240 defines a pitch distance 300 (referred to hereafter as "pitch") and a lead distance 302 (referred to hereafter as "lead"). The pitch 300 is the axial distance between adjacent crests of the worm gear 240. The lead 302 is the linear distance that the rack 238 is advanced (moving the movable jaw 32 in the direction of arrows 244 or 246) for each complete rotation of the worm gear 240. A conventionally threaded worm gear, such as the worm gears 40 and 140 illustrated in FIGS. 1-5, includes a single thread wrapped helically around the worm gear. The pitch and the lead of the conventional worm gear are equal; therefore the conventional worm gear advances a rack a linear distance equal to the pitch for each complete rotation. In contrast, the illustrated worm gear 240 includes two separate threads 304 and 306, offset 180 degrees and wrapped helically around the worm gear 240. As such, the rack 238 advances twice the pitch 300 per rotation (i.e., the lead 302 is twice the pitch 300), thereby requiring less rotation of the worm gear 240 adjust the relative spacing between the jaws 230 and 232.

Accordingly, the invention provides, among other things, a wrench that automatically increases a clamping force on a fastener to reduce the likelihood that jaws of the wrench will round off corners of fasteners. Also, the clamping force is automatically decreased when the user is finished rotating the wrench, which allows the user to easily remove the jaws from fasteners.

Various features and advantages of the invention are set forth in the following claims.

What is claimed is:

1. A wrench configured to rotate a fastener, the wrench comprising:

a handle;

a head pivotally coupled to the handle, the head including, a first jaw configured to engage the fastener, and a second jaw configured to engage the fastener, the second jaw movable with respect to the first jaw to adjust a distance between the first jaw and the second jaw, an actuator operable to move the second jaw with respect to the first jaw to adjust the distance, wherein the handle is pivotally coupled to the head such that rotation of the handle with respect to the head moves the second jaw toward the first jaw, wherein the actuator includes a worm gear, wherein the actuator further includes a rack gear engaged with the worm gear, the rack gear fixed to the second jaw for movement with the second jaw, wherein the worm gear is rotatable with respect to the first jaw to move the rack gear and the second jaw with respect to the first jaw to adjust the distance between the first jaw and the second jaw, further comprising a lever including a first end portion and a second end portion, and the lever pivotally coupled to the head between the first end portion and the second end portion of the lever, wherein the second end portion of the lever contacts the handle to pivot the lever in response to rotation of the handle with respect to the head, and wherein the first end portion of the lever contacts the worm gear to move the worm gear, the rack gear, and the second jaw toward the first jaw in response to rotation of the handle with respect to the head and pivotal movement of the lever with respect to the head.

2. The wrench of claim 1, wherein the worm gear is a double lead worm gear.

3. The wrench of claim 1, further comprising a biasing member that biases the worm gear, the rack gear, and the second jaw away from the first jaw.

4. The wrench of claim 3, wherein the biasing member includes a coil spring.

5. The wrench of claim 1, wherein the head includes an aperture and wherein the rack gear is at least partially received within the aperture and the rack gear slides within the aperture to adjust the distance between the first jaw and the second jaw.

6. The wrench of claim 1, further comprising a biasing member that biases the second jaw away from the first jaw.

7. The wrench of claim 1, wherein the handle contacts the first jaw to limit pivotal movement of the handle with respect to the head.

8. The wrench of claim 1, wherein the handle is an elongated handle having a front end portion and a rear end portion, wherein the head is pivotally coupled to the handle at the front end portion, and wherein an aperture extends through the handle at the rear end portion of the handle.

9. The wrench of claim 1, wherein the first jaw includes a contact surface configured to engage the fastener and the second jaw includes a contact surface configured to engage the fastener, and wherein the contact surface of the first jaw is parallel to the contact surface of the second jaw.

10. The wrench of claim 1, wherein the actuator is rotatable to move the second jaw with respect to the first jaw to adjust the distance, and wherein the handle is pivotally coupled to the head such that rotation of the handle with respect to the head moves the second jaw toward the first jaw without rotation of the actuator.

11. A wrench configured to rotate a hex head nut, the wrench comprising:

a handle;

a head pivotally coupled to the handle, the head including, a first jaw including a first contact surface configured to engage the hex head nut, and a second jaw including a second contact surface configured to engage the hex head nut, the second contact surface parallel to the first contact surface, the second jaw movable with respect to the first jaw to adjust a distance between the first and second contact surfaces, a rack gear fixed to the second jaw for movement with the second jaw relative to the first jaw;

a worm gear rotatable with respect to the first jaw to move the rack gear and the second jaw with respect to the first jaw to adjust the distance between the first contact surface and the second contact surface; and a lever pivotally coupled to the head, the lever pivotable with respect to the head to move the second jaw toward the first jaw in response to rotation of the handle with respect to the head to increase a clamping force of the first jaw and the second jaw on the hex head nut;

wherein the lever includes a first end portion and a second end portion, and the lever is pivotally coupled to the head between the first end portion and the second end portion of the lever, wherein the second end portion of the lever contacts the handle to pivot the lever in response to rotation of the handle with respect to the head, and wherein the first end portion of the lever contacts the worm gear to move the worm gear, the rack gear, and the second jaw toward the first jaw in response to rotation of the handle with respect to the head and pivotal movement of the lever with respect to the head.

12. The wrench of claim 11, wherein the worm gear is a double lead worm gear.

13. The wrench of claim 11, further comprising a biasing member that biases the worm gear, the rack gear, and the second jaw away from the first jaw.

14. The wrench of claim 11, wherein the head includes an aperture and wherein the rack gear is at least partially received within the aperture and the rack gear slides within the aperture to adjust the distance between the first jaw and the second jaw.

15. The wrench of claim 11, wherein the handle contacts the first jaw to limit pivotal movement of the handle with respect to the head.

* * * * *